US010160516B2

(12) United States Patent
Hong et al.

(10) Patent No.: US 10,160,516 B2
(45) Date of Patent: Dec. 25, 2018

(54) MARINE STRUCTURE PLATFORM HAVING MOVEMENT DAMPING FUNCTION AND SUBMERSIBLE MARINE STRUCTURE HAVING SAME

(71) Applicant: Korea Institute of Ocean Science & Technology, Ansan-si, Gyeonggi-do (KR)

(72) Inventors: Key Yong Hong, Daejeon (KR); Kang Su Lee, Incheon (KR); Jong Su Choi, Daejeon (KR); Kyong Hwan Kim, Daejeon (KR); Se Wan Park, Daejeon (KR)

(73) Assignee: Korea Institute of Ocean Science & Technology, Ansan-si (KR)

( * ) Notice: Subject to any disclaimer, the term of this patent is extended or adjusted under 35 U.S.C. 154(b) by 0 days.

(21) Appl. No.: 15/543,955

(22) PCT Filed: Apr. 30, 2015

(86) PCT No.: PCT/KR2015/004442
§ 371 (c)(1),
(2) Date: Jul. 14, 2017

(87) PCT Pub. No.: WO2016/088953
PCT Pub. Date: Jun. 9, 2016

(65) Prior Publication Data

US 2017/0320543 A1 Nov. 9, 2017

(30) Foreign Application Priority Data

Dec. 1, 2014 (KR) ..... 10-2014-0169845

(51) Int. Cl.
*B63B 1/10* (2006.01)
*B63B 35/44* (2006.01)
(Continued)

(52) U.S. Cl.
CPC ..... *B63B 1/107* (2013.01); *B63B 35/44* (2013.01); *B63B 35/4413* (2013.01); *B63B 2001/128* (2013.01); *B63B 2039/067* (2013.01)

(58) Field of Classification Search
CPC ..... B63B 39/03; B63B 39/06; B63B 39/062; B63B 1/107; B63B 35/44; B63B 35/4413
(Continued)

(56) References Cited

U.S. PATENT DOCUMENTS 6,102,625 A * 8/2000 Olsen ..... B63B 39/005 114/126
2014/0305359 A1 10/2014 Lambrakos et al.

FOREIGN PATENT DOCUMENTS

KR 10-2010-0090991 A 8/2010
KR 10-2011-0071404 A 6/2011
(Continued)

*Primary Examiner* — Lars A Olson
(74) *Attorney, Agent, or Firm* — Novick, Kim & Lee, PLLC; Sang Ho Lee

(57) ABSTRACT

The present invention provides a marine structure platform including: horizontal connecting parts which are disposed under the seawater and connected to one another in a lattice structure; vertical connecting parts which are installed uprightly at four corners of the horizontal connecting parts and protrude from the seawater; and movement damping parts which are extended at the four corners from the vertical connecting parts along the horizontal connecting parts adjacent to one another, the movement damping parts having a plate shape so as to define a vertical gap therebetween.

12 Claims, 9 Drawing Sheets

(51) Int. Cl.
*B63B 39/06* (2006.01)
*B63B 1/12* (2006.01)

(58) Field of Classification Search
USPC ..... 114/126, 264
See application file for complete search history.

(56) References Cited

FOREIGN PATENT DOCUMENTS

| | | | |
|---|---|---|---|
| KR | 10-2013-0091148 | A | 8/2013 |
| KR | 10-2013-0107587 | A | 10/2013 |
| KR | 10-2014-0025696 | A | 3/2014 |

* cited by examiner

MARINE STRUCTURE PLATFORM HAVING MOVEMENT DAMPING FUNCTION AND SUBMERSIBLE MARINE STRUCTURE HAVING SAME

TECHNICAL FIELD

The present invention relates to a marine structure, and more particularly, to a marine structure platform having a movement damping function capable of efficiently damping a heaving motion, a rolling motion, and a pitching motion of the marine structure platform on the sea, and to a semi-submersible marine structure respectively.

BACKGROUND ART

In general, a semi-submersible marine structure such as a combined cycle power generation structure on the sea, has a high-priced drilling system for performing drilling operations on an upper deck, and the semi-submersible marine structure is moored at a predetermined location and floats in the sea.

For example, in the case of a semi-submersible marine structure such as a drilling rig, various types of equipment are extended from an upper deck of the drilling rig to the seabed during the drilling operation, and as a result, the drilling operation is significantly affected by upward and downward motion of the drilling rig.

That is, since the semi-submersible marine structure is in use while floating in the sea, the semi-submersible marine structure is inevitably moved due to a flow of seawater.

That is, in a case in which a heaving motion, a rolling motion, and a pitching motion of the marine structure consistently occur on the sea, these motions greatly affect performance of various types of drilling equipment installed on the marine structure, and there is a concern that the drilling equipment could be damaged.

As a document in the related art relevant to the present invention, there is Korean Patent Application Laid-Open No. 10-2010-0090991 (Publication Date: Aug. 18, 2010).

DISCLOSURE

Technical Problem

An object of the present invention is to provide a marine structure platform having a movement damping function capable of efficiently damping a heaving motion, a rolling motion, and a pitching motion on the sea, and enabling a marine structure to be stably moored on the sea, and a semi-submersible marine structure respectively.

Another object of the present invention is to provide a marine structure platform having a movement damping function capable of improving supporting force at a portion where a pontoon and a column are connected to each other, and ensuring stability of a structure on the sea, and a semi-submersible marine structure respectively.

Technical Solution

The present invention provides a marine structure platform including: horizontal connecting parts which are disposed under the seawater and connected to one another in a lattice structure; vertical connecting parts which are installed uprightly at four corners of horizontal connecting parts and protrude from the seawater; and movement damping parts which are extended at four corners from vertical connecting parts along horizontal connecting parts adjacent to one another, movement damping parts having a plate shape to define a vertical gap.

The movement damping part may include a pair of movement damping plates which defines the gap and may be opened along an interior of the horizontal connecting parts.

Outer circumferences of the pair of movement damping plates surrounded by the horizontal connecting parts may be formed in a polygonal shape, a circular shape, or a fan shape.

A vortex inducing hole may be formed in the pair of movement damping plates so as to vertically penetrate the pair of movement damping plates.

The vortex inducing hole may be formed to expose a part of the vertical connecting part.

A part of an inner circumference of the vortex inducing hole surrounded by the horizontal connecting parts may be formed to have a shape corresponding to a shape of an outer circumference of each of the pair of movement damping plates.

One or more vertical reinforcing members may be installed in a space between the pair of movement damping plates so as to connect and support the pair of movement damping plates.

The vertical reinforcing member may be formed in a cylindrical shape, a circular column shape, a quadrangular container shape, a square column shape, or an I-beam shape.

A radial reinforcing member may be formed on at least one of the pair of movement damping plates.

The radial reinforcing member may be formed along an inner surface of the movement damping plate so as to connect a circumference of the vertical reinforcing member and a circumference of the movement damping plate.

In another aspect, the present invention provides a semi-submersible marine structure including the marine structure platform.

Advantageous Effects

According to the present invention, it is possible to efficiently damp a heaving motion, a rolling motion, and a pitching motion on the sea, thereby enabling the marine structure to be stably moored.

In addition, according to the present invention, it is possible to improve supporting force at the portion where the pontoon and the column are connected to each other, thereby ensuring stability of the structure on the sea.

BEST MODE

Hereinafter, a marine structure having a marine structure platform according to the present invention will be described with reference to the accompanying drawings.

The marine structure according to the present invention is a semi-submersible marine structure which is a facility that is moored on the sea and performs combined cycle power generation.

Figure 1:
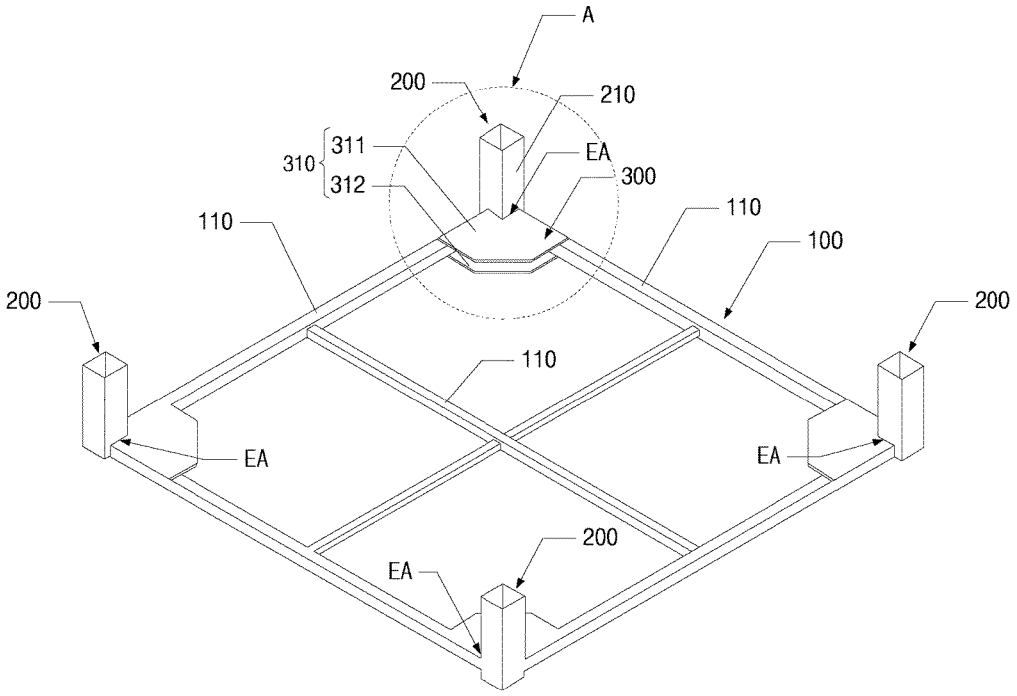
FIG. 1 is a perspective view illustrating a marine structure platform of the present invention.
Figure 2:
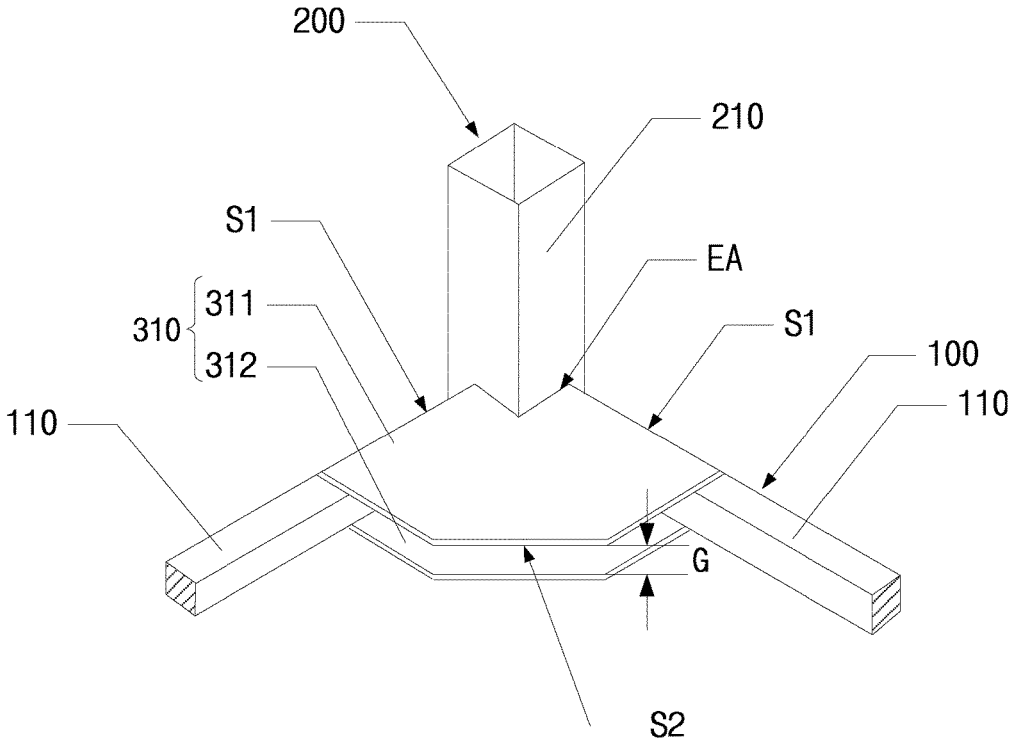
FIG. 2 is an enlarged perspective view of part A in FIG. 1.
Figure 3:
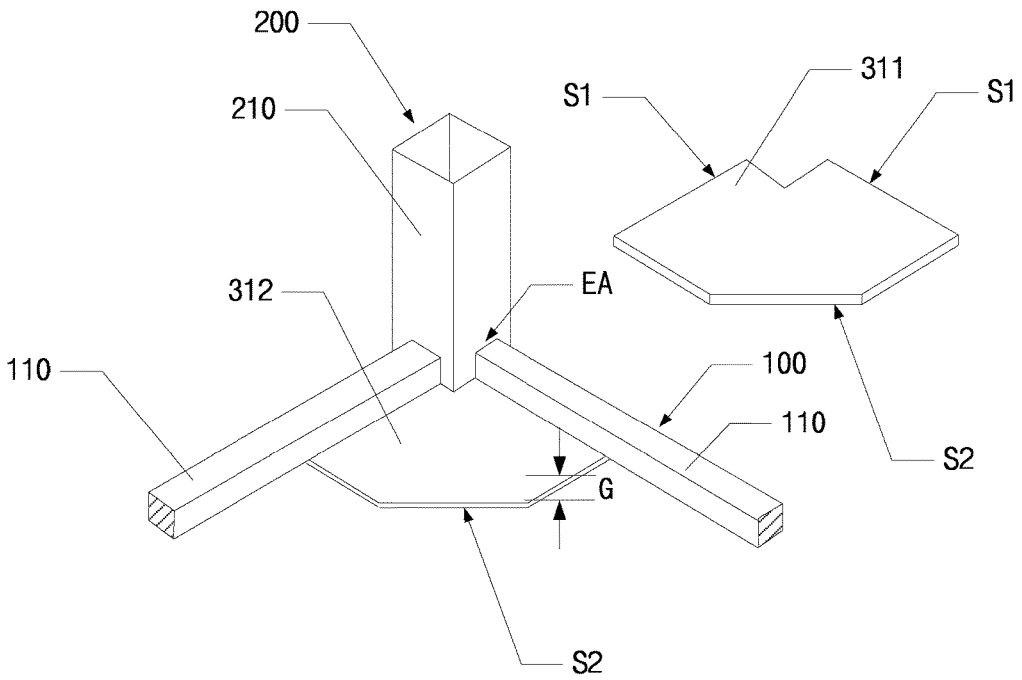
FIG. 3 is a view illustrating a state before movement damping plates according to the present invention are coupled.

FIG. 1 is a perspective view illustrating a marine structure platform of the present invention, FIG. 2 is an enlarged perspective view of part A in FIG. 1, and FIG. 3 is a view illustrating a state before movement damping plates according to the present invention are coupled.

Referring to FIGS. 1 to 3, the marine structure according to the present invention has a marine structure platform.

The marine structure platform broadly includes horizontal connecting parts 100, vertical connecting parts 200, and movement damping parts 300.

Horizontal Connecting Part 100

The horizontal connecting parts 100 have a lattice structure, and the horizontal connecting parts 100 are disposed on the sea. Here, the horizontal connecting parts 100 include pontoons 110.

That is, the horizontal connecting parts 100 include the pontoons 110 that define a frame having a lattice structure.

Of course, in the present invention, an example in which the horizontal connecting parts 100 have a lattice structure is representatively described, but other structures may be applied instead of the lattice structure.

Vertical Connecting Part 200

The vertical connecting part 200 according to the present invention is configured as a column 210 having a shape like a vertical frame.

The vertical connecting parts 200 are installed at four corners of the horizontal connecting parts 100 so as to be perpendicular to the horizontal connecting parts 100.

Therefore, a total of four vertical connecting parts 200 may be provided.

In addition, the four vertical connecting parts 200 may protrude from the sea at the four corners of the horizontal connecting parts 100.

Although not illustrated in the drawings, a deck of the marine structure may be installed at an upper end of each of the vertical connecting parts 200.

Movement Damping Part 300

As illustrated in FIGS. 1 and 2, in the present invention, there are a total of four sections at the four corners of the horizontal connecting parts 100, and each of the four sections includes the two pontoons 110, and the single column 210 perpendicular to a corner between the two pontoons 110.

Hereinafter, the four sections are referred to as corner regions EA. Therefore, the four corner regions EA are formed between the horizontal connecting parts 100 and the vertical connecting parts 200 according to the present invention.

The movement damping parts 300 according to the present invention are installed in the four corner regions EA.

Referring to FIGS. 2 and 3, the movement damping part 300 includes a pair of movement damping plates 310.

Here, the pair of movement damping plates 310 may have the same size and the same shape.

The movement damping plate 310 has a plate body which includes a pair of connecting surfaces S1 that form a right angle therebetween, and a circumferential surface S2 that connects the pair of connecting surfaces S1 so as to define an outer circumference.

That is, one corner of the plate body is connected to the column 210, and the pair of connecting surfaces S1 is extended from one corner along the two pontoons 110 adjacent to the plate body.

In addition, the circumferential surface S2 is formed in a polygonal shape, and particularly, the circumferential surface S2 may be cut out to define three surfaces.

Further, the corner of the plate body is formed to be fitted with a circumference with the corresponding column 210, and the corner of the plate body may be connected to the column 210 by welding.

In addition, the portions, which define the connecting surfaces S1 of the plate body, may be installed on upper or lower surfaces of the two pontoons 110 by welding.

Meanwhile, the pair of movement damping plates 310 includes an upper movement damping plate 311 and a lower movement damping plate 312.

The upper and lower movement damping plates 311 and 312 have the same shape, and the upper and lower movement damping plates 311 and 312 are installed in each of the corner regions EA.

The upper movement damping plate 311 is installed on the upper surfaces of the two pontoons 110 in the corresponding corner region EA, and the lower movement damping plate 312 is installed on the lower surfaces of the two pontoons 210 in the corresponding corner region EA.

Therefore, the upper and lower movement damping plates 311 and 312 are disposed to face each other vertically.

A space having a gap G is formed between the upper and lower movement damping plates 311 and 312, and the space is opened toward one side.

In the present invention, supporting force may be increased since the movement damping plates 310 are installed on the upper and lower surfaces of the two pontoons 110, respectively, in each of the four corner regions EA as described above.

As illustrated in FIG. 2, in the present invention, the reason why the upper and lower movement damping plates 311 and 312 are attached to the upper and lower surfaces of the pontoons 11 is to form only a thickness of a shell of the movement damping plates 310 by allowing the upper and lower movement damping plates 311 and 312 to be individually separated and spaced apart from each other, thereby reducing a thickness of a location at which a vortex occurs in comparison with a case in which a movement damping plate is installed only at a lower side of the pontoon 110.

Here, the occurrence of the vortex is decreased as the thickness of the movement damping plates 310 is increased, such that viscous damping is decreased.

Therefore, the occurrence of the vortex is increased, such that the viscous damping may be increased, and a movement reducing effect may be maximized.

In addition, in the present invention, the movement damping plates 310, instead of a single plate, are configured to be separated from each other vertically in each of the corner regions EA, and this configuration may be advantageous in reducing movements of the structure.

Figure 4:
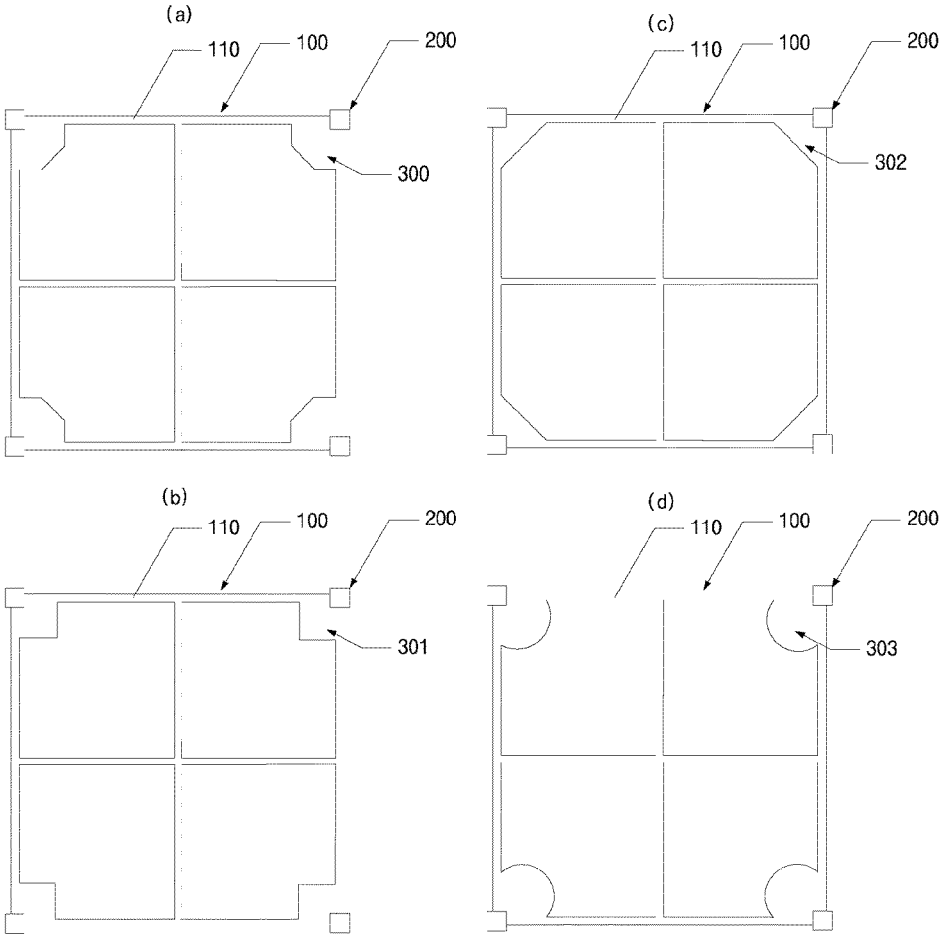
FIG. 4 is a view illustrating examples of various shapes of movement damping parts according to the present invention.

FIG. 4 is a view illustrating examples of various shapes of the movement damping parts according to the present invention.

Referring to FIG. 4, the movement damping plate according to the present invention may be formed in shapes illustrated in FIGS. 1 to 3, and 4A, or may be formed in quadrangular and triangular plate shapes as illustrated in FIGS. 4B and 4C.

In addition, as illustrated in FIG. 4D, the movement damping plate may be formed in a fan shape or a circular plate shape.

Figure 5:
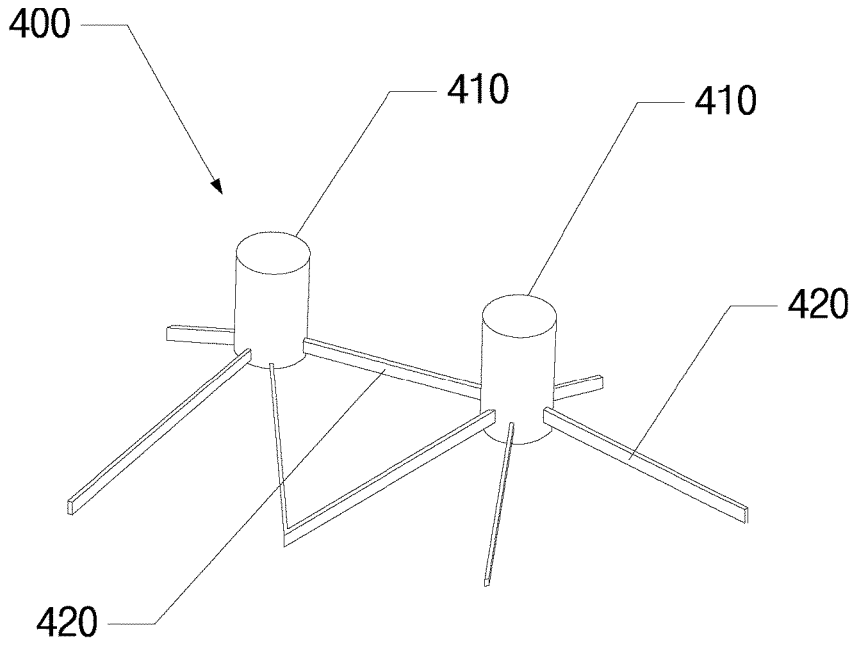
FIG. 5 is a perspective view illustrating a reinforcing part according to the present invention.
Figure 6:
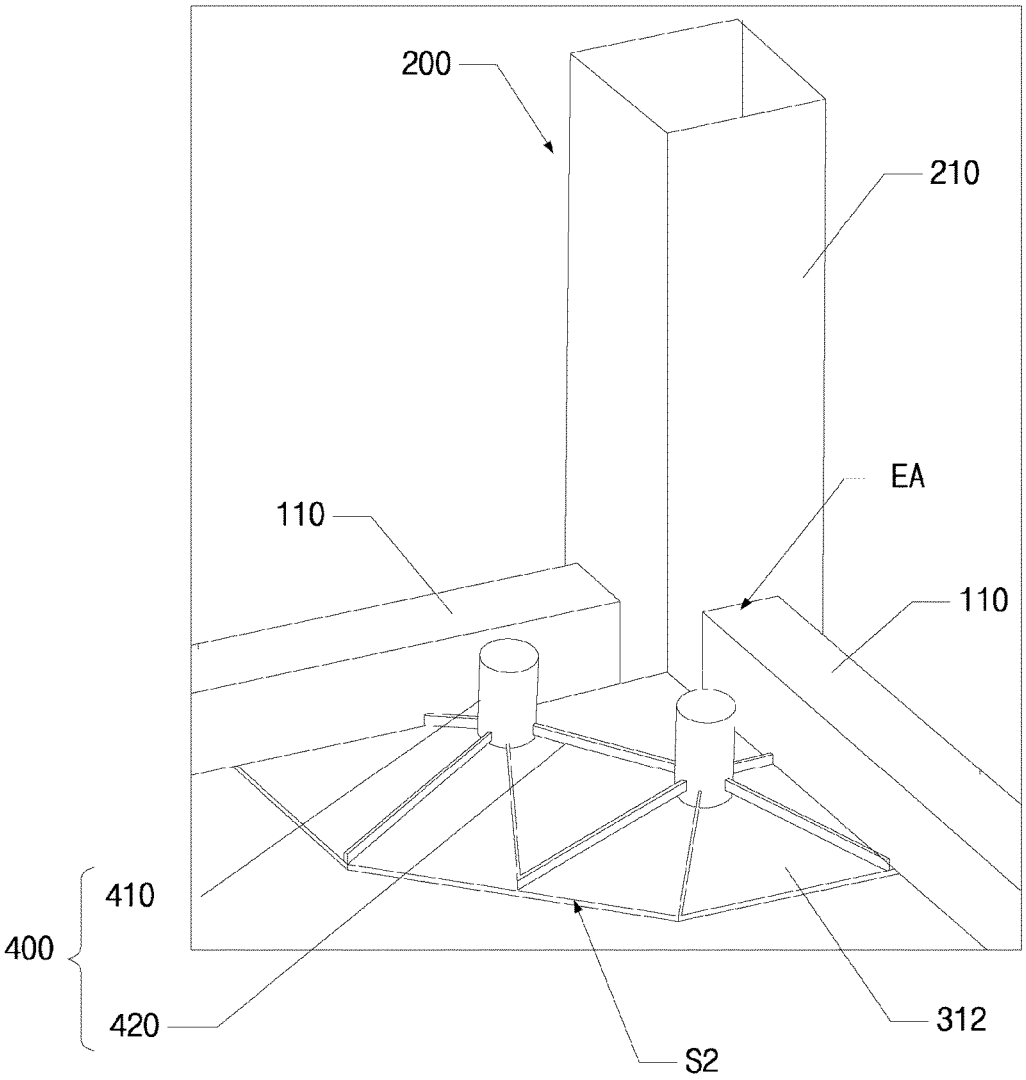
FIGS. 6 and 7 are perspective views illustrating examples in which vertical and radial reinforcing members installed in the movement damping part according to the present invention.
Figure 7:
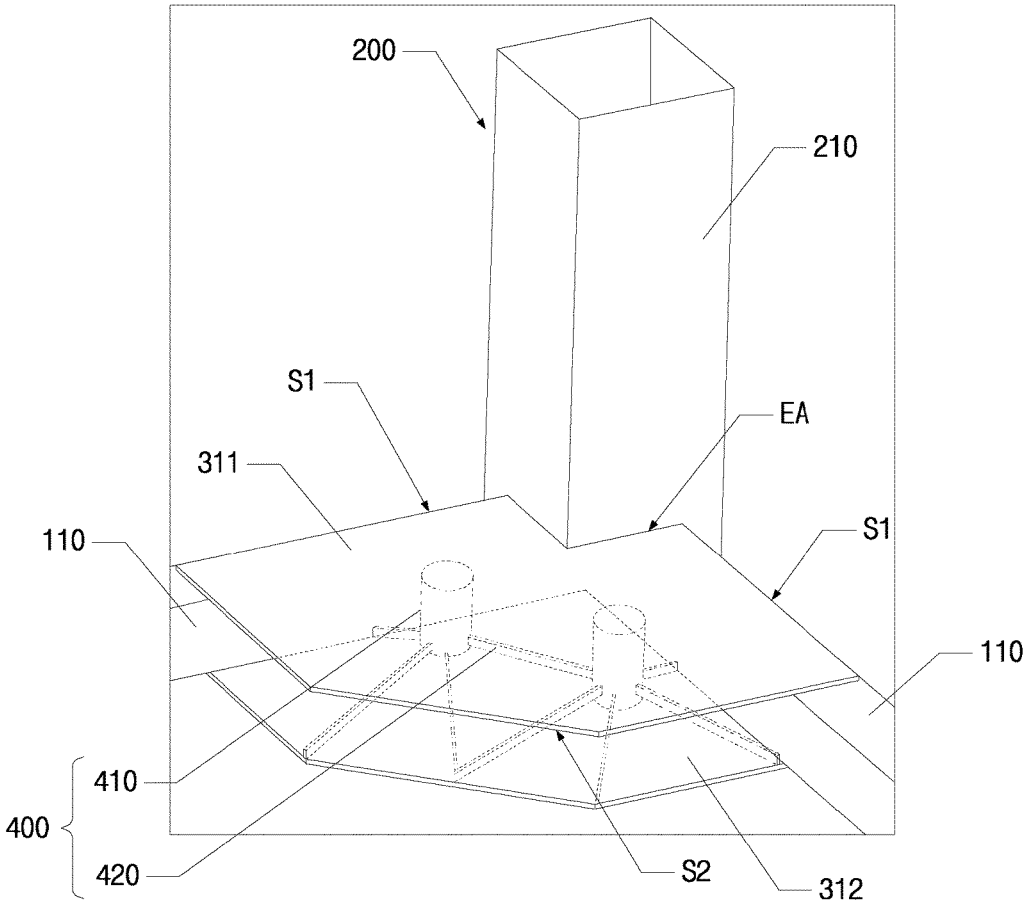

FIG. 5 is a perspective view illustrating a reinforcing part according to the present invention, FIGS. 6 and 7 are perspective views illustrating examples in which vertical and radial reinforcing members installed in the movement damping part according to the present invention.

Referring to FIGS. 5 to 7, the movement damping part 300 according to the present invention has a reinforcing part 400.

The reinforcing part 400 includes vertical reinforcing members 410 and radial reinforcing members 420.

One or more vertical reinforcing members 410 are provided and installed between the pair of movement damping plates 310.

The vertical reinforcing member 410 is formed in a cylindrical shape, a circular column shape, a quadrangular container shape, a square column shape, or an I-beam shape.

An upper end of the vertical reinforcing member 410 supports a lower surface of the upper movement damping plate 311, and a lower end of the vertical reinforcing member 410 supports an upper surface of the lower movement damping plate 312.

Particularly, the vertical reinforcing member 410 may be fixed to the upper and lower movement damping plates 311 and 312 by welding.

In addition, in a case in which a single vertical reinforcing member 410 is installed, the single vertical reinforcing member 410 may be installed at a central portion of the movement damping plates 310.

Furthermore, the radial reinforcing members 420 are installed on at least one of the pair of movement damping plates 310.

The radial reinforcing members 420 are installed along an inner surface of the movement damping plate 310 so as to connect a circumference of the vertical reinforcing member 410 and a circumference of the movement damping plate 310.

FIGS. 4 and 5 illustrate an example in which the radial reinforcing members 420 are installed on the lower movement damping plate 312.

The radial reinforcing members (radial stiffener) 420 are formed to be radially extended from the circumference of the vertical reinforcing member 410.

Here, an end of the radial reinforcing member 420 is connected to an outer periphery of the lower movement damping plate 312.

With the aforementioned configuration, the movement damping plates 310 of the movement damping part 300, which is installed in each of the four corner regions EA in the present invention, are supported by the vertical reinforcing members 410 and the radial reinforcing members 420, and as a result, it is possible to solve a problem of warping of the structure caused by external force such as waves in the sea, and it is possible to easily disperse and eliminate the external force.

Figure 8:
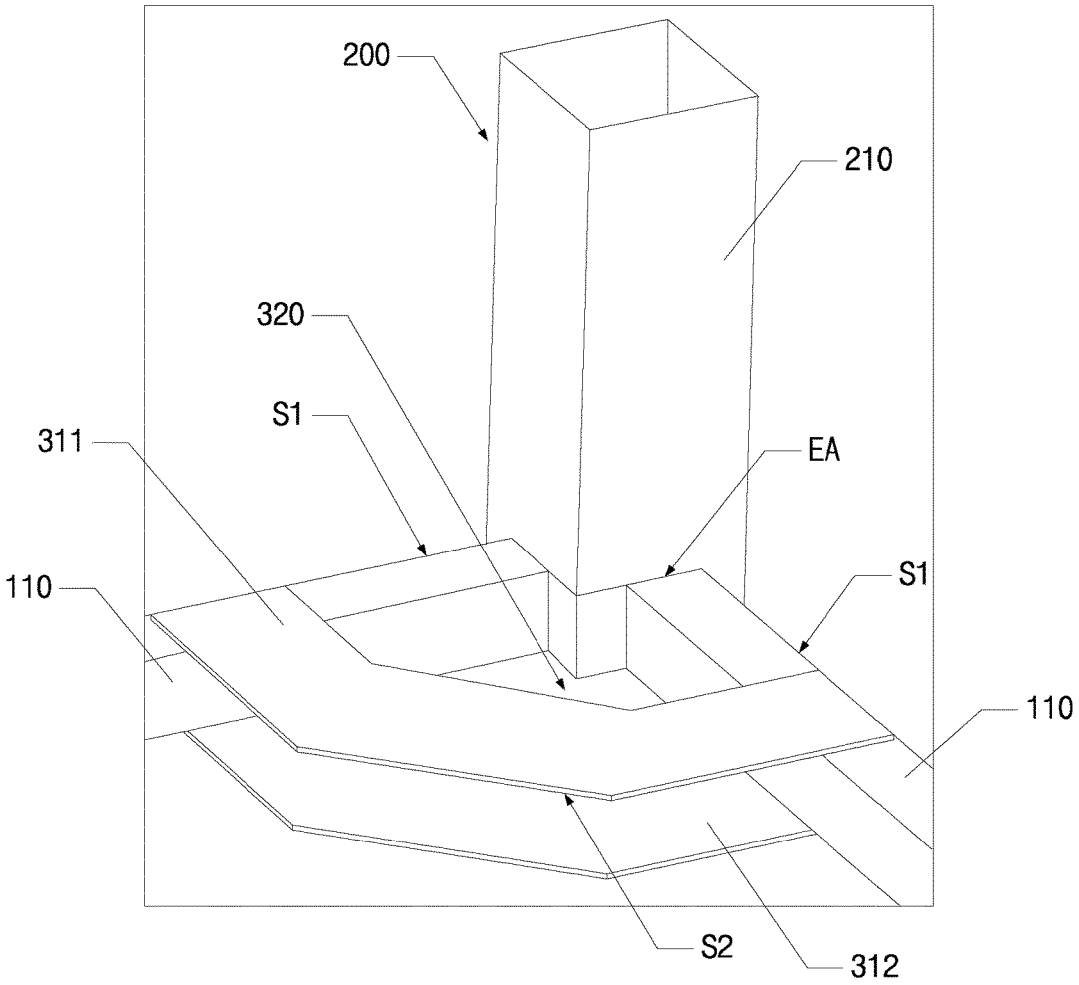
FIG. 8 is a perspective view illustrating an example in which a vortex inducing hole is formed in the movement damping part according to the present invention.

FIG. 8 is a perspective view illustrating an example in which a vortex inducing hole is formed in the movement damping part according to the present invention.

Referring to FIG. 8, a vortex inducing hole 320 is formed in the movement damping parts 300 according to the present invention.

The vortex inducing hole 320 is formed to penetrate the pair of movement damping plates 310, and particularly, the vortex inducing hole 320 is formed such that the column 210 is exposed in the corresponding corner region EA.

In addition, a shape of the vortex inducing hole 320 may be correspond to a shape of the movement damping plates 310.

Therefore, in the present invention, since the vortex inducing hole 320 is formed in the movement damping part 300 installed in each of the four corner regions EA, a vortex is easily formed in each of the corner regions EA, thereby efficiently reducing movements of the structure.

Figure 9:
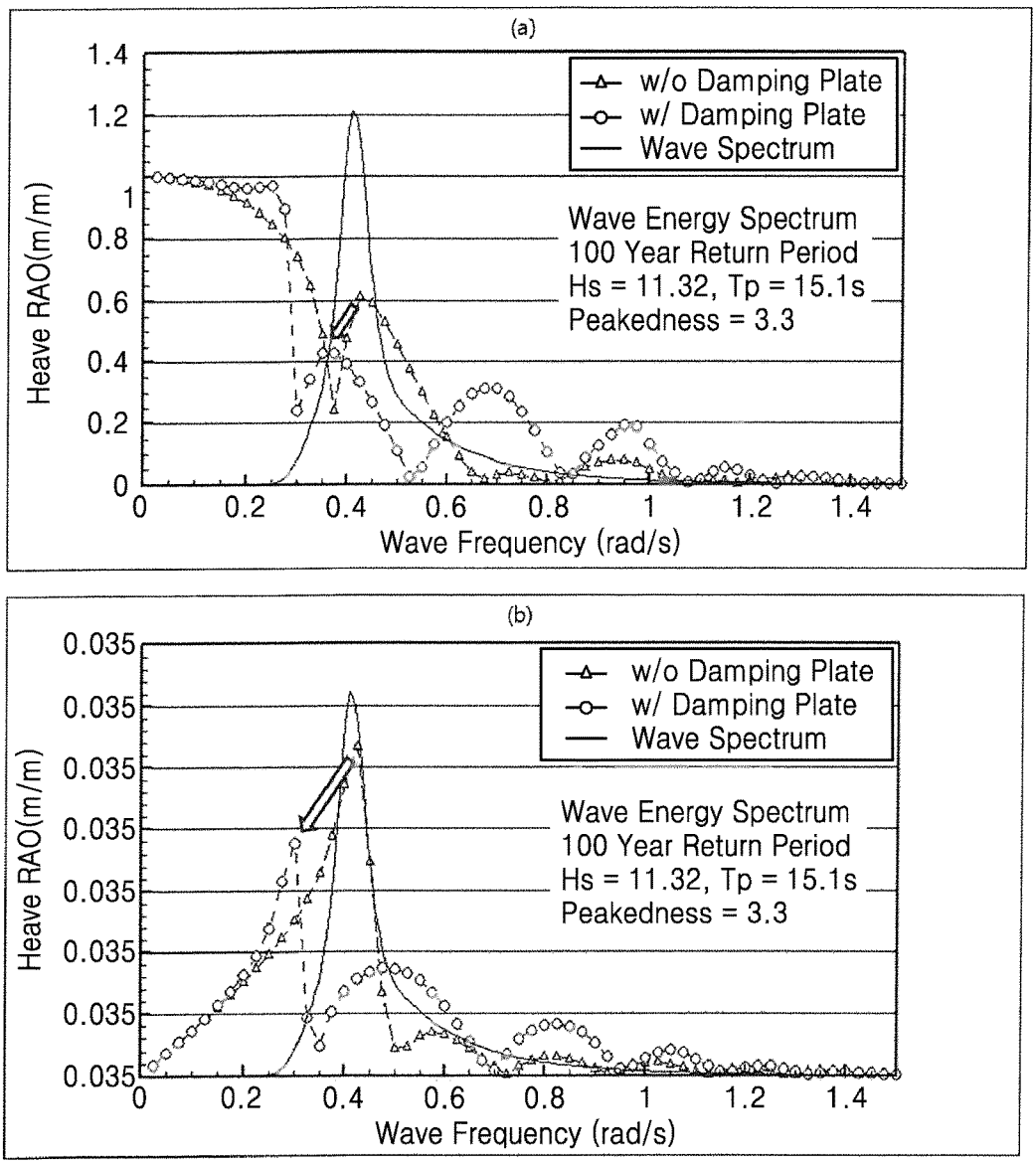
FIG. 9 is a graph for comparing the marine structure according to the present invention with a marine structure without an installed movement damping part in terms of resonant motion responses and resonant motion periods.

FIG. 9 is a graph for comparing the marine structure according to the present invention with a marine structure without an installed movement damping part in terms of resonant motion responses and resonant motion periods.

FIG. 9A illustrates a result of a heaving motion, and FIG. 9B illustrates a result of a pitching motion.

FIGS. 9A and 9B illustrate results of comparing the marine structure (w/Damping Plate) according to the present invention with a marine structure (w/o Damping Plate) without a movement damping part in terms of resonant motion responses and resonant motion periods.

FIGS. 9A and 9B illustrate the results obtained by numerical analyses. According to the results, it can be seen that in the case of a heaving motion and a pitching motion, the resonant motion response is more reduced and the resonant motion period moves toward a long period (low frequency) by the marine structure (w/Damping Plate) according to the present invention in comparison with the marine structure without an installed movement damping part.

Here, RAO (response amplitude operator) is an indication for indicating a magnitude of a movement of the structure, and 'Wave frequency' is an indication for indicating properties of waves.

According to the exemplary embodiment of the present invention with the aforementioned configurations and operations, a heaving motion, a rolling motion, and a pitching motion on the sea may be efficiently damped, and as a result, the marine structure may be stably moored on the sea.

In addition, according to the exemplary embodiment of the present invention, it is possible to improve supporting force at the portion where the pontoon and the column are connected to each other, thereby ensuring stability of the structure on the sea.

While the specific exemplary embodiments related with the marine structure having the marine structure platform according to the present invention have been described above, the exemplary embodiments may be modified to various exemplary embodiments without departing from the scope of the present invention.

Therefore, the scope of the present invention should not be limited to the described exemplary embodiment, but should be defined by the appended claims and the equivalents of the claims.

Accordingly, it should be understood that the aforementioned exemplary embodiment is described for illustration in all aspects and is not limited, and the scope of the present invention shall be represented by the claims to be described below, instead of the detailed description, and it should be construed that all of the changes or modified forms induced from the meaning and the scope of the claims, and an equivalent concept thereto are included in the scope of the present invention.

The invention claimed is:

1. A marine structure platform comprising:

horizontal connecting parts which are disposed on the sea and connected to one another in a lattice structure;

vertical connecting parts which are installed uprightly at four corners of the horizontal connecting parts and protruded from the seawater; and movement damping parts which are extended at four corners from the vertical connecting parts along the horizontal connecting parts adjacent to one another, each of the movement damping parts having a plate shape and defining a vertical gap therebetween, wherein the movement damping parts have a pair of movement damping plates which define the vertical gap and are opened along an interior of the horizontal connecting parts, wherein one or more vertical reinforcing members are installed in a space between the air of movement damping plates and connect and support the pair of movement damping plates, and wherein a radial reinforcing member is radially extended in a circumferential direction of the vertical reinforcing member on at least one of the pair of movement damping plates.

2. The marine structure platform of claim 1, wherein outer circumferences of the pair of movement damping plates surrounded by the horizontal connecting parts are formed in a polygonal shape, a circular shape, or a fan shape.

3. The marine structure platform of claim 1, wherein a vortex inducing hole is formed on the pair of movement damping plates and vertically penetrates the pair of movement damping plates, and the vortex inducing hole is formed to expose a part of the vertical connecting part outside.

4. The marine structure platform of claim 3, wherein a part of an inner circumference of the vortex inducing hole surrounded by the horizontal connecting parts is formed to have a shape corresponding to a shape of an outer circumference of each of the pair of movement damping plates.

5. The marine structure platform of claim 1, wherein the vertical reinforcing member is formed in a cylindrical shape, a circular column shape, a quadrangular container shape, a square column shape, or an I-beam shape.

6. The marine structure platform of claim 5, wherein the radial reinforcing member is formed along an inner surface of the movement damping plates and connects a circumference of the vertical reinforcing member and a circumference of the movement damping plates.

7. A semi-submersible marine structure comprising a marine structure platform, the marine structure platform comprising:

horizontal connecting parts which are disposed on the sea and connected to one another in a lattice structure;

vertical connecting parts which are installed uprightly at four corners of the horizontal connecting parts and protruded from the seawater; and movement damping parts which are extended at four corners from the vertical connecting parts along the horizontal connecting parts adjacent to one another, each of the movement damping parts having a plate shape and defining a vertical gap therebetween, wherein the movement damping parts have a pair of movement damping plates which define the vertical gap and are opened along an interior of the horizontal connecting parts, wherein one or more vertical reinforcing members are installed in a space between the pair of movement damping plates and connect and support the pair of movement damping plates, and wherein a radial reinforcing member is radially extended in a circumferential direction of the vertical reinforcing member on at least one of the pair of movement damping plates.

8. The semi-submersible marine structure comprising the marine structure platform of claim 7, wherein outer circumferences of the pair of movement damping plates surrounded by the horizontal connecting parts are formed in a polygonal shape, a circular shape, or a fan shape.

9. The semi-submersible marine structure comprising the marine structure platform of claim 7, wherein a vortex inducing hole is formed on the pair of movement damping plates and vertically penetrates the pair of movement damping plates, and the vortex inducing hole is formed to expose a part of the vertical connecting part outside.

10. The semi-submersible marine structure comprising the marine structure platform of claim 9, wherein a part of an inner circumference of the vortex inducing hole surrounded by the horizontal connecting parts is formed to have a shape corresponding to a shape of an outer circumference of each of the pair of movement damping plates.

11. The semi-submersible marine structure comprising the marine structure platform of claim 7, wherein the vertical reinforcing member is formed in a cylindrical shape, a circular column shape, a quadrangular container shape, a square column shape, or an I-beam shape.

12. The semi-submersible marine structure comprising the marine structure platform of claim 11, wherein the radial reinforcing member is formed along an inner surface of the movement damping plates and connects a circumference of the vertical reinforcing member and a circumference of the movement damping plates.

* * * * *